US005509522A

United States Patent [19]

Laidlaw

[11] Patent Number: 5,509,522

[45] Date of Patent: Apr. 23, 1996

[54] QUICK RELEASE HOPPER AND IMPROVED CYLINDRICAL DISPENSING MEMBER FOR INDIVIDUAL CIGARETTE VENDING MACHINE

[76] Inventor: Ronald W. Laidlaw, 8790 E. Lupine Dr., Scottsdale, Ariz. 85260

[21] Appl. No.: 240,833

[22] Filed: May 11, 1994

Related U.S. Application Data

[63] Continuation-in-part of Ser. No. 138,685, Oct. 18, 1993, Pat. No. 5,450,980, which is a continuation-in-part of Ser. No. 967,788, Oct. 28, 1992, Pat. No. 5,351,856.

[51] Int. Cl.[6] ..... G07F 11/44

[52] U.S. Cl. ..... 194/350; 221/196; 221/197

[58] Field of Search ..... 194/236, 237, 194/247, 255, 292, 350; 221/131, 196, 197, 198, 203, 207, 266, 281

[56] References Cited

U.S. PATENT DOCUMENTS

| | | | |
|---|---|---|---|
| 1,512,464 | 10/1924 | Hekrdle | 221/266 |
| 1,986,658 | 1/1935 | Witter | 221/197 |
| 4,288,004 | 9/1981 | Göhringer et al. | 221/266 X |
| 4,326,620 | 4/1982 | Felix et al. | 194/350 X |
| 4,850,511 | 7/1989 | Kral et al. | 221/197 X |
| 4,869,395 | 9/1989 | Rubbmark | 221/131 |
| 5,005,698 | 4/1991 | Mikhail | 206/257 |

FOREIGN PATENT DOCUMENTS

| | | | |
|---|---|---|---|
| 525216 | 8/1940 | United Kingdom | 221/266 |
| 2207793 | 2/1989 | United Kingdom | 194/350 |

*Primary Examiner*—F. J. Bartuska
*Attorney, Agent, or Firm*—H. Gordon Shields

[57] ABSTRACT

A quick release hopper 60 and an improved cylindrical dispensing member 70 for an individual cigarette vending machine 10. The quick release hopper 60 has a rotatable dispensing member 70, a hopper slot 61 at its bottom that aligns with a dispensing member slot 71 in the rotatable dispensing member 70, and an inboard end 54 of a handle 53 of a coin mechanism 50 that slides through the hopper slot 61 and engages with the dispensing member slot 71. The hopper 60 has flanged edges 62 that extend from a side of the hopper 60, and the flanged edges 62 engage with grooves 40 located in the compartment 30 of the vending machine 10. The slots and flanged edges allow the hopper 60 to be easily inserted and removed from the vending machine 10. The improved dispensing member 70 has axial slots 72 that are rectangularly-shaped. It further has a flat edge 73 in the cylindrical peripheral surface 74 at the leading edge of the axial slot 72 in the direction of rotation, and the flat edge 73 is chamfered relative to the side walls of the axial slot 70 so that cigarettes 91 fall more easily and gradually into the axial slot 72 of the dispensing member 70.

9 Claims, 3 Drawing Sheets

QUICK RELEASE HOPPER AND IMPROVED CYLINDRICAL DISPENSING MEMBER FOR INDIVIDUAL CIGARETTE VENDING MACHINE

This is a continuation-in-part of application Ser. No. 08/138,685 filed on Oct. 18, 1993 now U.S. Pat. No. 5,450,980, which is a continuation-in-part of application Ser. No. 07/967,788 filed on Oct. 28, 1992 now U.S. Pat. No. 5,351,856.

BACKGROUND OF THE INVENTION

1. Fields of the Invention

The present invention relates generally to vending machines, and more particularly, to improvements to an individual cigarette vending machine.

2. Discussion of Background and Prior Art

Vending machines that dispense cigarettes individually have been developed to overcome certain prior art problems such as growing health and social concerns of smokers in reducing their amount of smoking, complicated and expensive coin and bill changers for handling large bill purchases, and massive floor space occupied by conventional cigarette machines. In particular, a single cigarette vending machine was developed and disclosed by Mr. Ronald Laidlaw in his copending patent application entitled "VENDING MACHINE FOR INDIVIDUAL CIGARETTES" Ser. No. 07/967,788 filed on Oct. 28, 1992 and in his copending patent application entitled "COIN OPERATED VENDING MACHINE FOR VENDING INDIVIDUAL CIGARETTES FROM A CIGARETTE MANUFACTURER'S CONTAINER" Ser. No. 08/138,685 filed on Oct. 18, 1993.

In both of these applications, a hopper having a dispensing member mounted to its bottom end was disclosed as being coupled to a coin mechanism. A plurality of cigarettes was loaded into and retained by a hopper, and the rotation of the coin mechanism rotated the dispensing member to dispense cigarettes from the hopper.

In these applications, however, the hopper was integrally mounted to the coin mechanism such that the hopper was practically fixed to the vending machine. This integral mounting of the hopper created the problem of having to take off an entire front panel of the machine to disengage the inboard end of a coin mechanism from the outward end of the dispenser member before the hopper could be removed from or inserted into the machine during loading and reloading operations. As a result, this problem made it a very cumbersome task for the person who would have to load and reload the hopper with cigarettes.

Furthermore, in the copending application filed on Oct. 18, 1993, the dispensing of a single or a plurality of cigarettes for each turn of the coin mechanism was achieved by either interchanging the dispensing member or filling the axial slots in the dispensing member with slugs depending on the desired number of cigarettes to be dispensed for each turn of the coin mechanism. Therefore, the integral mounting of the hopper also made it a difficult task for a person having to interchange the dispensing member or insert slugs into the dispensing member since the entire panel and coin mechanism assembly of the machine would also have to be dismounted in order to reach the dispensing member. Therefore, a quick release hopper, which avoids these cumbersome tasks of dismounting various parts of the vending machine in order to reach the hopper and dispensing member is desired.

Also, in the prior copending applications, the dispensing member is disclosed as having a general cylindrical, peripheral surface and at least one axial slot, that is round or angularly shaped. The problem with the features of this dispensing member is that the cigarettes could still be misaligned or jammed between the hopper wall and the round or angularly-shaped slot of the dispensing member. This problem would then result in the malfunction or jamming of the vending machine. Therefore, an improved dispensing member, which overcomes the misalignment and jamming problems, is also desired.

SUMMARY OF THE INVENTION

Set forth below is a brief summary of the invention in order to solve the foregoing problems and achieve the foregoing and other objects, benefits, and advantages in accordance with the purposes of the present invention as embodied and broadly described therein.

Accordingly, it is an object and advantage of the present invention to provide a quick release hopper, a quick release front panel and an improved cylindrical dispensing member for an individual cigarette vending machine.

It is one aspect and advantage of the present invention to provide a cigarette vending machine having a compartment for receiving a hopper for holding a plurality of cigarettes, a rotatable dispensing member mounted to a bottom end of the hopper for receiving the cigarettes from the hopper and dispensing them individually from the compartment, wherein the improvement comprises the hopper being a quick release type wherein the compartment has a pair of grooves for slidably receiving hopper portions therein.

It is another aspect of the present invention to provide a method for vending cigarettes from a machine which includes the steps of supporting a removable hopper in a compartment within the machine, loading the hopper with a plurality of cigarettes, mounting a dispensing member at a bottom end of the hopper to receive cigarettes from the hopper, and dispensing them individually directly therefrom, wherein the improvement comprises the step of slideably receiving hopper portions within a pair of grooves in the compartment, whereby the hopper is quickly removable from the compartment for the loading step and reinsertable into the compartment for the dispensing step.

It is another aspect of the present invention to provide a cigarette vending machine having a hopper for holding a plurality of cigarettes and a compartment for receiving the hopper, wherein the improvement comprises a flat-edged, rotatable dispensing member mounted to the hopper for receiving the cigarettes from the hopper and dispensing them individually from the compartment.

It is another aspect of the present invention to provide a method for vending cigarettes from a machine which includes the steps of loading a hopper with a plurality of cigarettes wherein the improvement comprises the step of dispensing a cigarette directly from the hopper by rotating a dispensing member which first allows the cigarette to roll by gravity onto a flat edge and then allows the cigarette to roll into a rectangularly-shaped, axial slot, the flat edge being at the leading edge of the axial slot relative to the direction of rotation, the flat edge and the axial slot being located in a cylindrical, peripheral surface of the rotatable dispensing member.

It is another aspect of the present invention to provide a cigarette vending machine having a compartment with a back wall, side walls and a front wall supported on at least one of the other walls which together form a compartment for retaining a hopper that holds a plurality of cigarettes, and a rotatably dispensing member mounted to a bottom end of the hopper for receiving the cigarettes from the hopper and dispensing them individually from the compartment, wherein the improvement comprises the front wall of the compartment being of a quick release type wherein the front wall can be quickly detached from the supporting compartment wall for allowing easy access to the hopper and can then be quickly reattached to the supporting compartment wall.

DETAILED DESCRIPTION OF THE PREFERRED EMBODIMENT

Figure 1:
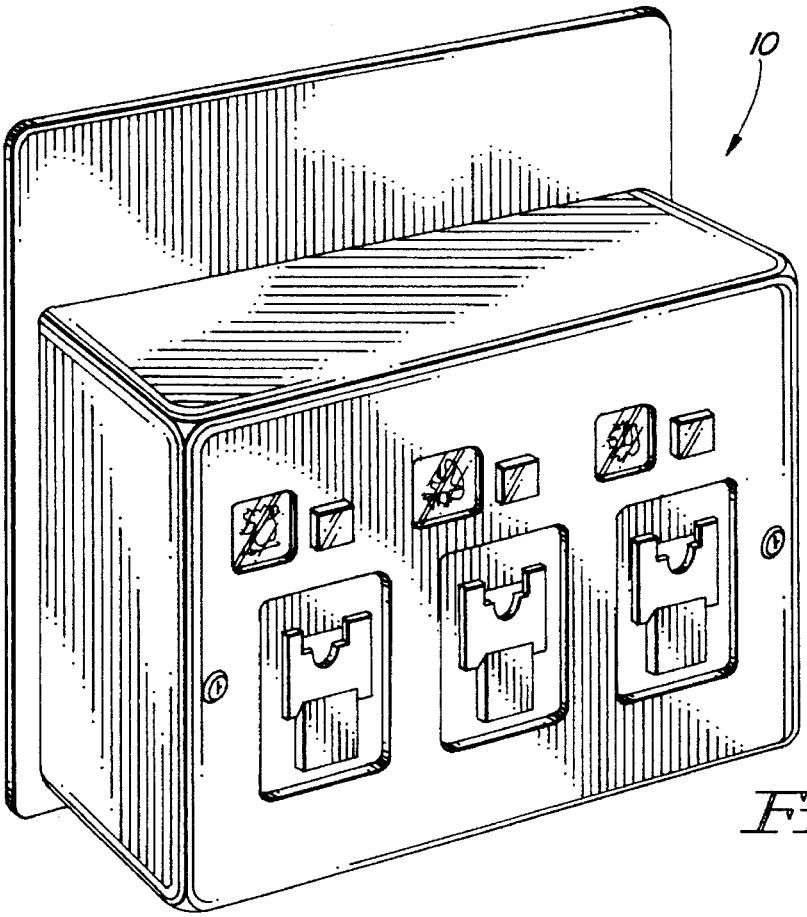
FIG. 1 —Front view of the preferred embodiment of the vending machine that dispenses individual cigarettes.

FIG. 1 shows a front side view of an individual cigarette vending machine 10 that is similar to the machines disclosed in applicant's copending applications Ser. No. 08/138,685 filed on Oct. 18, 1993 and Ser. No. 07/967,788 filed on Oct. 28, 1992. Vending machine 10 dispenses individual cigarettes in accordance with the improvements and preferred embodiment of the present application.

Figure 2:
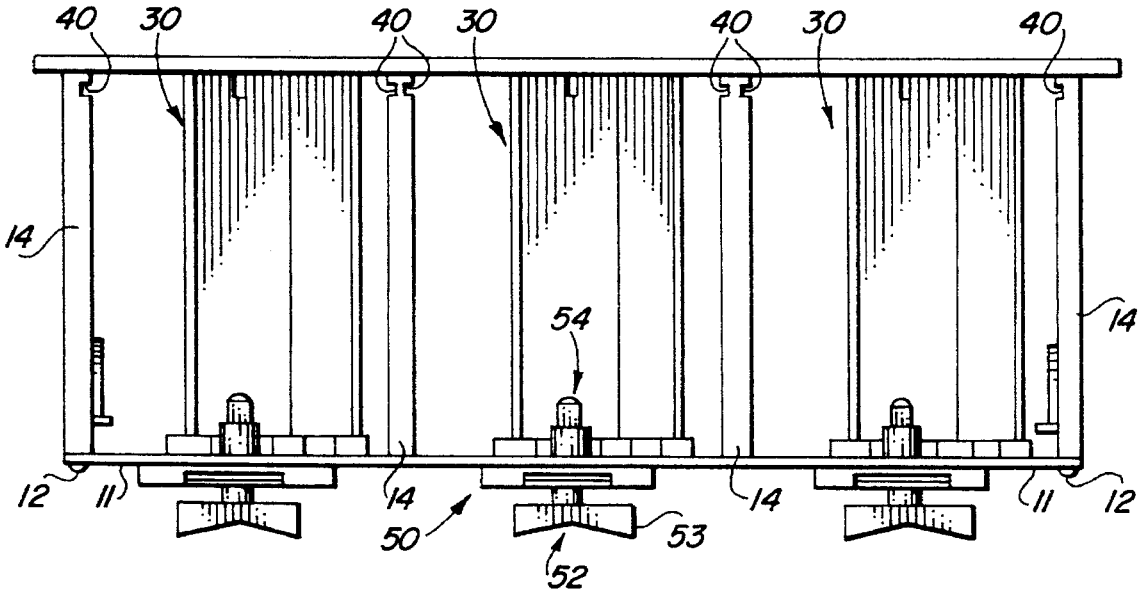
FIG. 2 —Top view showing the inside of the preferred embodiment vending machine without hoppers and further showing the grooves and inboard end of the coin mechanism handle.

In FIG. 2, a top view of the inside of the vending machine is shown. FIG. 2 shows compartments 30, in which each compartment 30 can receive a hopper 60. In each of the compartments 30, a pair of grooves 40 is located at the back end and on opposite side walls of the compartment 30. Coin mechanism 50 is located at the front wall 11 of the vending machine 10. An outboard end 52 and handle 53 of the coin mechanism 50 is located outside of the compartment 30 (see FIGS. 2 and 3) while an inboard end 54 is located inside of the compartment 30 (see FIG. 2).

Figure 6:
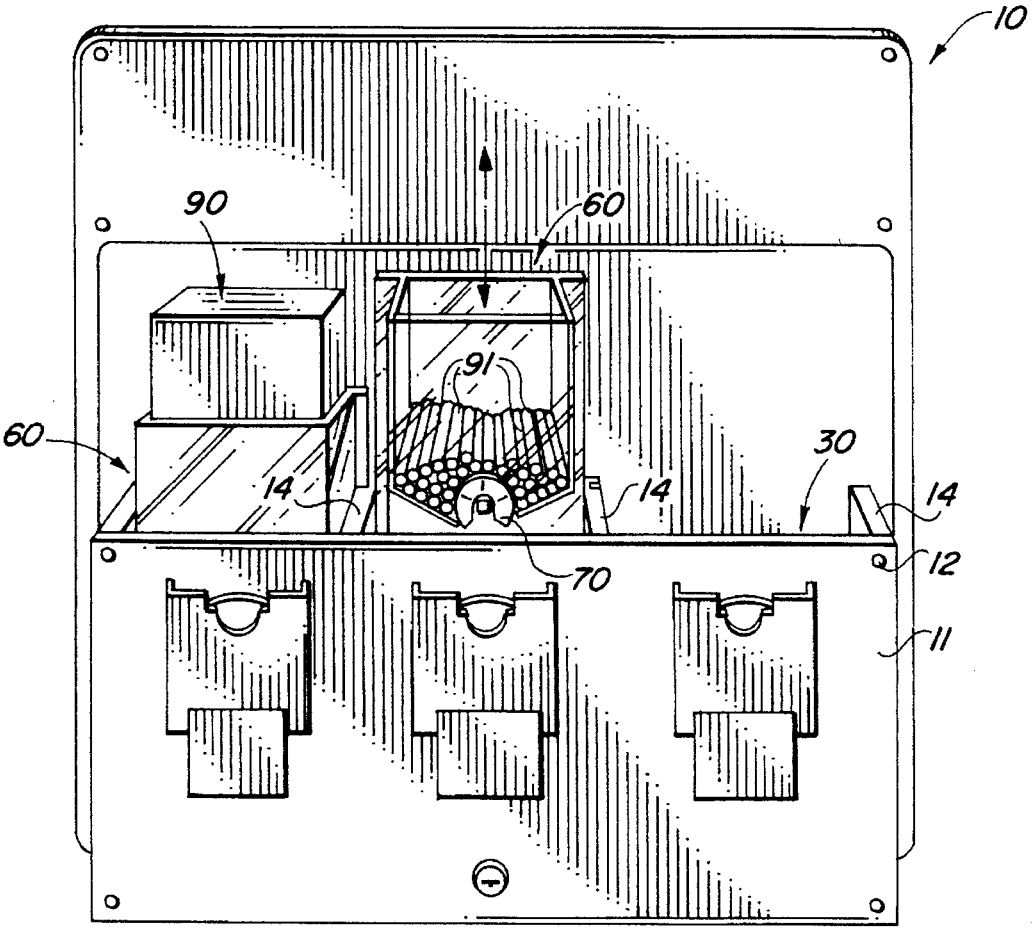
FIG. 6 —Front view showing the inside of the preferred embodiment vending machine with hoppers.
Figure 6A:
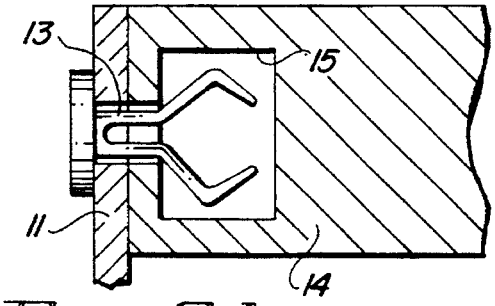
FIG. 6A —Partial side view of FIG. 6 showing fender clips in lieu of screws enabling quick release front panel.

As one embodiment of the present invention, the front wall 11 is attached to the sidewalls 14 by screws 12 (FIG. 6). Alternatively, as shown in FIG. 6A, quick release fender clips 13 may be used instead of screws 12 which permits the front panel to be quickly removed by pulling the entire front panel 11 outwardly to disengage the fender clips 13 from their frictional engagement in holes 15 in the front end of the walls of compartments 30 disengaging the inboard end 54 of the coin mechanism 50 from the outboard 52 end of the dispensing member 70. This feature enables quick access to the hoppers which may be affixed to the compartments by screws in slots as in applicant's prior applications, or may be of the quick release type described below in this application. Of course, in the latter case, the front panel 11 need not be removed at all.

Quick Release Hopper

Figure 3:
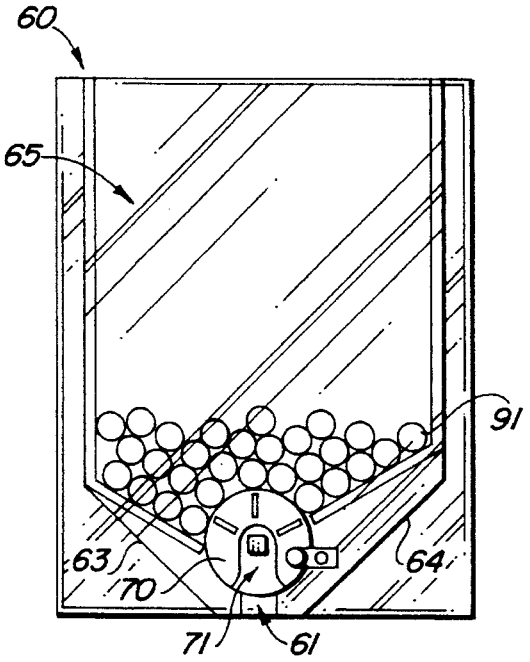
FIG. 3 —Front view of the quick release hopper with a dispensing member.
Figure 4:
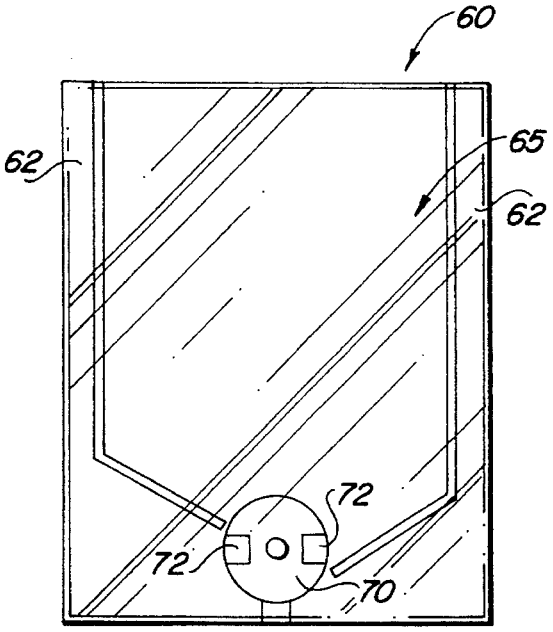
FIG. 4 —Back view of the quick release hopper with a dispensing member.

FIG. 3 shows the front side view of the quick release hopper in its right-side-up position while FIG. 4 shows the back side view of the quick release hopper 60 in its right-side-up position. The quick release hopper 60 is one of the unique features of applicant's invention.

Quick release hopper 60 generally has a hopper bin 65, a slanted bottom receiving wall 63 and a slanted bottom dispensing wall 64. As shown in FIGS. 3 and 4, a rotatable dispensing member 70 is mounted at the bottom of hopper 60. The rotatable dispensing member 70 has axial slots 72, which are rotated above the bottom receiving wall 63 for receiving the cigarette 91 and are further rotated past the bottom dispensing wall 64 for dispensing the cigarette 91 (see FIG. 3).

Dispensing member 70 is interchangeable, and it can have a single or multiple number of axial slots 72. Some of the slots 72 can have slugs inserted in them depending on the desired number of cigarettes to be dispensed for each rotation of coin mechanism 50. Dispensing member 70 also has a dispensing member slot 71 (see FIG. 3), in which the inboard end 54 of handle 53 engages therein for rotating the dispensing member when handle 53 is turned. A slot 61 is also provided at the bottom of hopper 60 so that the dispensing member insertion slot 71 and hopper slot 61 can be aligned together so that the aligned slots can slide over the inboard end 54 which will then engage with the dispensing member insertion slot 71.

Furthermore, FIG. 4 shows hopper 60 with a pair of side edges 62. Each edge 62 is flanged and extends outward from a side of the hopper bin 65. The edges 62 correspondingly slide into and engage with the pair of grooves 40 in the sidewalls of a compartment 30.

Figure 5:
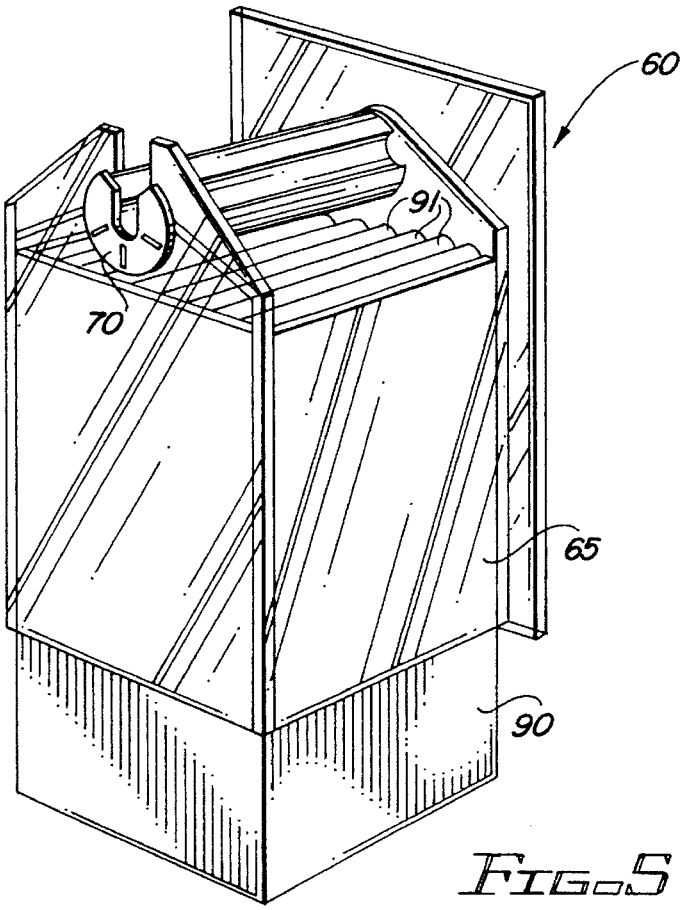
FIG. 5 —Perspective view of the quick release hopper inverted and loaded with a carton of cigarettes.

FIG. 5 shows the loading of the quick release hopper 60 with cigarettes 91. Hopper 60 is first removed, then inverted to an upside-down position and placed over a container 90 of cigarettes 91, the end of the container 90 having been removed. Cigarettes 91 can either be a plurality of tubed or untubed cigarettes and container 90 can be an original manufacturer's container. The hopper 60 is then turned back to its right-side-up position with the container 90 therein so that the cigarettes fall by gravity from the container 90 into the hopper 60 which is thereby loaded. The container 90 can either remain in or be removed from the hopper 60. (The container 90 is preferably left in the hopper in complying with the federal regulations).

After the cigarettes 91 are loaded, the hopper 60 is placed into compartment 30 of vending machine 10. Referring to FIG. 3, before the insertion of hopper 60 into compartment 30, a dispensing member insertion slot 71 in the dispensing member 70 is aligned with the hopper slot 61. Referring to FIG. 2, hopper 60 is then placed into compartment 30 by slidably engaging the pair of flanged edges 62 into the corresponding pair of grooves 40 in compartment 30.

Inboard end 54 slides through the hopper slot 61 and also slides through and engages with dispensing member slot 71 of dispensing member 70. Inboard end 54 can be a square end. After hopper 60 is in place in compartment 30, the inboard end 54 of handle 53 engages with the dispensing member slot 71 so that the rotation of handle 53 drives the rotation of dispensing member to dispense cigarettes.

FIG. 6 shows the quick release hopper 60 easily inserted into or removed from compartment 30.

Improved Dispensing Member

Figure 7:
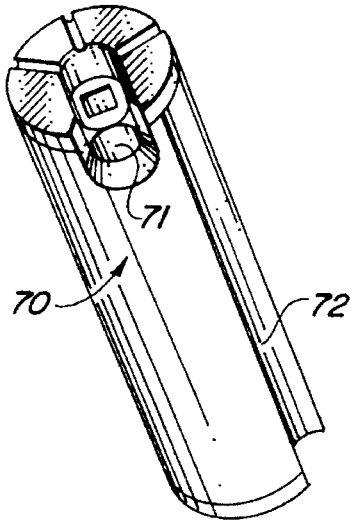
FIG. 7 —Front end perspective view of the improved dispensing member showing the dispensing member axial and installation slots.

Another novel feature of the present invention is the improved dispensing member 70. FIG. 7 shows a front end perspective view of the improved dispensing member 70. Dispensing member 70 has a dispensing member insertion slot 71, which is aligned with the hopper slot 61 which slidably engages with the inboard end 54 of handle 53 of coin mechanism 50 (see FIG. 3).

Figure 8:
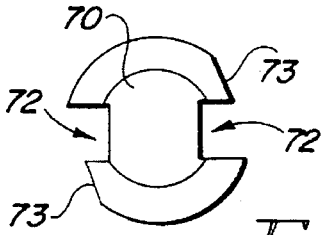
FIG. 8 —Back view of the improved dispensing member showing the flat edges and rectangularly-shaped axial slots.

FIG. 8 shows the back end side of the improved dispensing member 70. The improved dispensing member 70 is designed so that cigarettes 91 fall more easily into axial slots 72. FIG. 8 shows that the improved dispensing member 70 has a generally cylindrical, peripheral surface 74. Axial slots 72 receive and dispense cigarettes 91 from the hopper 60. Each axial slot 72 is rotated clockwise (as seen in FIG. 3, or counterclockwise as seen in FIG. 8) above the bottom receiving wall 63 for receiving a cigarette 91 and is further rotated past the bottom dispensing wall 64 for dispensing the cigarette 91 (see FIG. 3). A flat edge 73 is located in the cylindrical, peripheral surface 74 and at a leading edge of each axial slot 72 in the direction of rotation. The flat edge 73 is chamfered with respect to the side walls of the axial slot 72 so that the cigarette 91 falls onto the flat edge 73 moving toward and, thereby, more easily into axial slot 72.

Additionally, axial slots 72 are rectangularly-shaped so that the cigarette 91 more easily falls into and dispenses from slots 72. The rectangularly-shaped axial slots 72 reduce the misalignment and jamming of the cigarette 91 between the axial slot 72 and the receiving wall 63 or dispensing wall 64 since more space and inner defined edges are provided by the rectangular shape of axial slot 72.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed:

1. In a cigarette vending machine having:

a compartment for receiving a hopper for holding a plurality of cigarettes;

a rotatable dispensing member mounted to a bottom end of the hopper for receiving the cigarettes from the hopper and dispensing them individually form the compartment;

wherein the improvement comprises:

the hopper being a quick release type wherein the compartment has a pair of grooves for slidably receiving hopper portions therein;

a coin mechanism partially mounted in the compartment and coupled to the dispensing member for generally locking rotation of the dispensing member and for allowing the dispensing member to be rotated once when a required number of coins are inserted into the mechanism;

wherein the hopper has at its bottom a hopper slot; and wherein the rotatable dispensing member has at one end a dispensing member slot that is aligned with the hopper slot for slidably receiving the inboard end of the coin mechanism allowing the insertion and removal of the hopper respectively into and from the compartment.

2. The cigarette vending machine according to claim 1 wherein the hopper further comprises:

a hopper bin for holding the cigarettes; and the hopper portions are a pair of outwardly extended flanged side edges slideably engaging with the pair of grooves.

3. The cigarette vending machine according to claim 1 wherein the coin mechanism further comprises:

a coin slot for initially receiving the coins inserted into the machine by a customer;

a handle attached to the coin slot for rotating the dispensing member;

wherein the dispensing member has a dispensing member slot at one end which is aligned with the hopper slot at the bottom end of the hopper; and wherein the handle further comprises an inboard end that slides through the hopper slot and engages with the dispensing member slot when the hopper is inserted into the compartment and that slideably disengages from the dispensing member slot and slides through the hopper slot when the hopper is removed from the compartment.

4. The cigarette vending machine according to claim 3 wherein:

the inboard end is a square end.

5. The cigarette vending machine according to claim 1 wherein the plurality of cigarettes in the hopper are a plurality of tubed cigarettes.

6. The apparatus of claim 1 which further includes a flat-ended, rotatable dispensing member mounted to the hopper for receiving cigarettes from the hopper and dispensing them individually from the compartment.

7. The apparatus of claim 6 in which the flat-ended, rotatable dispensing member includes:

a generally cylindrical peripheral surface;

at least one axial slot in the cylindrical peripheral surface for receiving and dispensing a cigarette from the hopper whereby the at least one axial slot is rotated above a bottom receiving wall of the hopper for receiving a cigarette and is further rotated past a bottom dispensing wall of the hopper for dispensing the cigarette; and the flat edge being located in the cylindrical, peripheral surface and at a leading edge of each of the at least one axial slot in the direction of rotation.

8. The cigarette vending machine according to claim 7 wherein the at least one axial slot is rectangularly-shaped.

9. The cigarette vending machine according to claim 8 wherein the flat edge is chamfered relative to a side wall of the at least one axial slot.

* * * * *